US007465874B2

(12) United States Patent
Obleman, Jr.

(10) Patent No.: US 7,465,874 B2
(45) Date of Patent: Dec. 16, 2008

(54) ELECTRICAL GROUNDING STRIP

(75) Inventor: Michael R. Obleman, Jr., Cicero, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 39 days.

(21) Appl. No.: 11/650,658

(22) Filed: Jan. 8, 2007

(65) Prior Publication Data

US 2008/0164047 A1 Jul. 10, 2008

(51) Int. Cl.
*H01R 4/66* (2006.01)

(52) U.S. Cl. ..... 174/6; 174/3; 174/5 R; 174/51; 174/78; 174/5 SG; 439/98; 361/799

(58) Field of Classification Search ..... 174/6, 174/3, 5 R, 5 SG, 51, 78, 59, 35 C, 135, 40 CC; 439/92, 98, 100; 361/799, 753
See application file for complete search history.

(56) References Cited

U.S. PATENT DOCUMENTS

| | | | | |
|---|---|---|---|---|
| 3,629,485 | A | 12/1971 | Watanabe et al. | |
| 4,154,429 | A | 5/1979 | Brannan | |
| 4,476,576 | A | 10/1984 | Wheeler et al. | |
| 5,369,626 | A | 11/1994 | Carroll | |
| 6,288,327 | B1 * | 9/2001 | Tobias | 174/6 |
| 6,801,418 | B1 | 10/2004 | Epstein | |
| 6,972,369 | B2 | 12/2005 | Megason et al. | |

FOREIGN PATENT DOCUMENTS

| | | |
|---|---|---|
| FR | 2584242 | 1/1987 |

* cited by examiner

*Primary Examiner*—Dhiru R Patel
(74) *Attorney, Agent, or Firm*—Howard IP Law Group, PC

(57) ABSTRACT

An electrical grounding strip has a first link and a second link, wherein the second link is connected directly to the first link, and each of the first and second links has a portion lying substantially in a plane and has at least one electrically conductive spike attached to the portion. The spike projects generally orthogonally to the plane of the link portion. An electrically conductive ground strap is in electrically conductive contact with the spikes of each of the first and second links.

20 Claims, 4 Drawing Sheets

ELECTRICAL GROUNDING STRIP

FIELD OF THE INVENTION

The present invention relates generally to devices for electrical grounding and in particular to devices for electrical grounding for use with mobile electrical equipment.

BACKGROUND OF THE INVENTION

Electrical systems such as radar and communication systems require grounding. One known method (shown in FIG. 1) for grounding mobile electrical systems such as radar and communication systems has been to use a single grounding rod 110. The single grounding rod may be, for example, about eight feet long, and is driven into earth. Rod 110 is clamped to cable 112 by clamp 114, and has a connector 116 for being applied to a ground attachment of a device. One shortcoming of this method is that it is very difficult to use for rapidly deploying systems because it requires considerable crew effort and time to install the grounding rod. Another shortcoming is that such a rod is not re-usable because considerable time and energy would be required to completely pull out the grounding rod.

Another known method for grounding mobile radar and communication systems is to use a grounding kit, illustrated in FIG. 2. Such a grounding kit consists of a number of daisy chained stakes 210, about 10" (inches) long, all of which have to be installed by hand in a desired pattern. Each stake has to be individually forced into ground with the use of a hammer 220 and like tools. The stakes 210 are then connected to each other through a grounding cable 240, which is further connected to ground an electrical system 230. This requires substantial crew effort and time to drive each of the grounding stakes into the ground around the deployed system. Similarly, when the electrical equipment is to be redeployed or removed, all of the stakes have to be removed manually. This requires considerable crew effort and time because each stake has to be individually pulled out of the ground. It would be desirable to provide for decreased installation and removal time, both in overall time and personnel time, for devices to ground electrical equipment. This can facilitate, by way of example, deploying mobile radar, communications and other electrical systems.

SUMMARY OF THE INVENTION

An electrical grounding strip includes a first link connected directly to a second link. Each of the first and second links has a portion lying substantially in a plane and has at least one electrically conductive spike attached to the portion. The spike projects generally orthogonally to the plane. An electrically conductive flexible member, which is in electrically conductive contact with the spikes of each of the first and second links, grounds the mobile electrical system.

A method for grounding equipment includes the step of placing a strip made of a first and a second link, each of the first and second links having a planar portion and at least one spike which projects generally orthogonally from the planar portion, in a position such that each of the spikes of the first and second links is pointing toward a grounding surface, electrically connecting each of the spikes to the equipment and applying a load to each link to force each of the spikes into the grounding surface.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in typical grounding methods and systems. However, because such elements are well known in the art, and because they do not facilitate a better understanding of the present invention, a discussion of such elements is not provided herein. The disclosure herein is directed to all such variations and modifications known to those skilled in the art.

Figure 3:
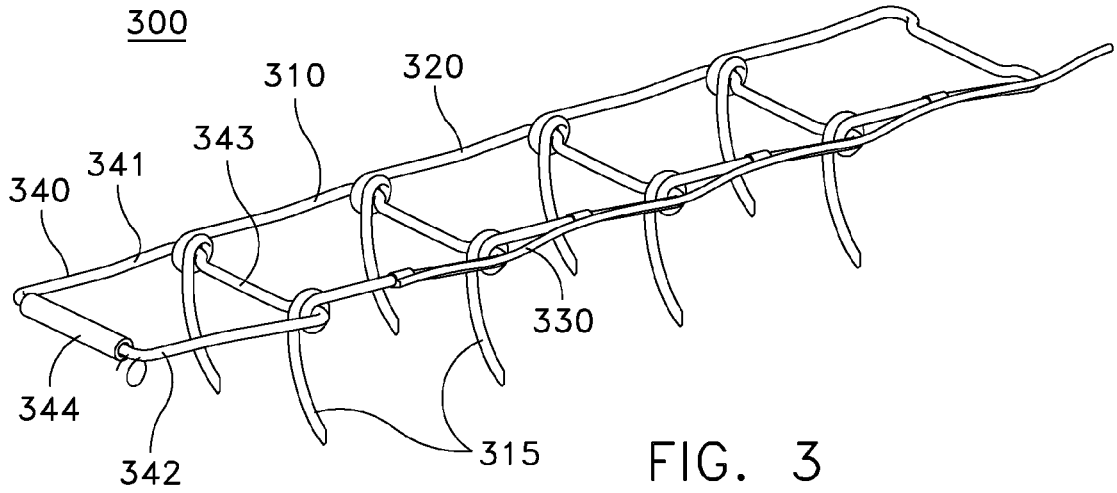
FIG. 3 illustrates an electrical grounding strip according to an embodiment of the invention.

Referring to FIG. 3, there is shown an electrical ground spike strip 300 in accordance with an embodiment of the invention. The spike strip 300 has two links 310, 320 which are connected directly and rotatably to each other. Each of the links 310, 320 has two spikes 315 each. Dependant upon the final configuration of the spike strip 300, additional links 310 may be added to provide the required grounding. The link 310 with two spikes 315 is only illustrative. Furthermore, it is possible to have one or more than two spikes on each link 310, as will be easily understood by a person of skill in the art. The spike strip 300 also includes a handle 340 which is directly and rotatably connected to link 310. A flexible, electrically conductive, grounding strap 330 is in electrically conductive contact with each of spikes 315 of the links 310, 320, and may be provided in electrically conductive contact to the equipment which is to be grounded. In the illustrated embodiment, each of links 310, 320 is made of a single piece of electrically conductive material, so that the illustrated physical connection between strap 330 and links 310, 320 provides electrically conductive connection with spikes 315.

Figure 4A:
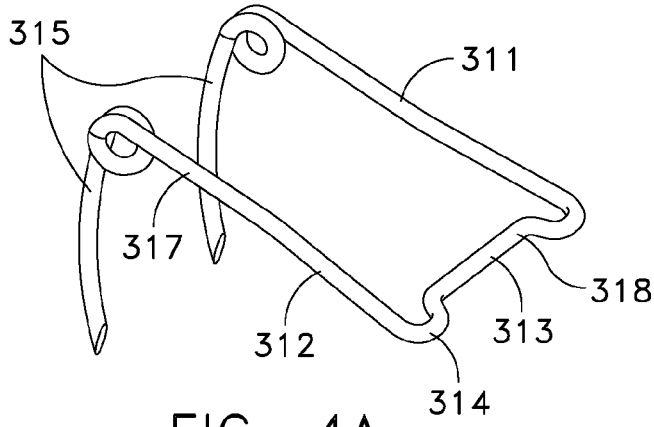
FIG. 4A illustrates a link of the grounding strip of FIG. 3.

Now referring to FIG. 4A, the link 310 is shown in greater detail. Three segments 311, 312 and 313 form a portion 317 of the link 310. The portion 317 lies substantially in a plane. In this illustrative only embodiment, the three segments 311, 312 and 313 define a generally rectangular frame. Segments 311 and 312 are generally straight and generally parallel to each other, defining two opposite sides of a rectangle. In this illustrative embodiment, segment 313 has a central portion 318 which is generally straight and two curved outward extending portions 314. Segment 311, at its end opposite to segment 313, joins an upper end of one of spikes 315. Segment 311 defines loop or coil 316 of about 450 degrees. An opening defined in the center of coil 316 is sufficiently large to receive a rod of the same size. Portions 314 may be received within coils 316. As an exemplary embodiment only, the spikes 315 may be about 8"-12" long. The spikes 315 are slightly curved inward toward the portion 317. Each spike has an elongated main portion of uniform diameter, and tapers to a point at a distal end thereof, opposite to the end connected to planar portion 317.

Figure 4B:
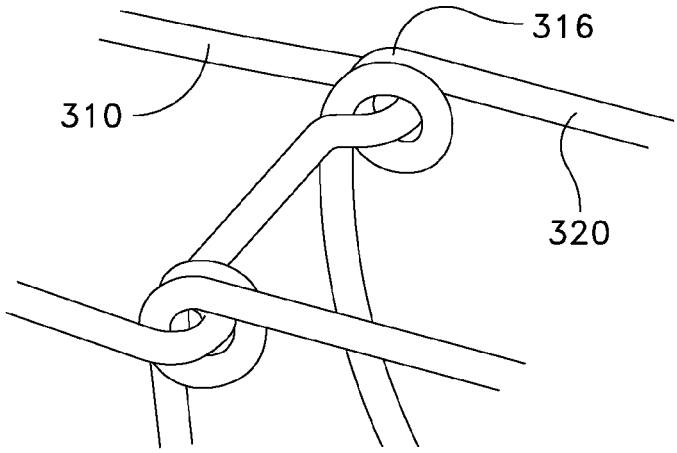
FIG. 4B illustrates a direct connection between two links of the grounding strip of FIG. 3.

In the illustrated embodiment, the three segments 311, 312 and 313, and spikes 315, are formed from a single elongated and shaped cylindrical rod. However, other manufacturing methods may be used to fabricate link 310. By way of example, three segments can be joined to form the portion 317, and the spikes joined to the portion 317, or a single elongated member can be shaped to form the link 310, including spikes 315, by bending, or casting or other manufacturing processes. It will be appreciated that coils 316 may be formed around portions 314 of adjoining links when spike strip 300 is formed. As seen in FIG. 4B, in this particular embodiment of the link connection, the coiled portions 316 of the spikes 315 are wrapped around the curved portions 314 of the member 313 to connect the link 320 with the link 310. The connection between the links 310 and 320 is pivoting or rotatable connection. Various other known joints can also be used to connect the link 310 with the link 320. In the illustrated embodiment of the invention in FIGS. 3 and 4B, the links 310 and 320 are identical.

Handle 340, shown in FIG. 3, has a generally rectangular frame, defined by straight side segments 341, 342, connecting end segment 343, and gripping end segment 344. Handle 340 lies in a plane. Connecting end segment 343, similar to segment 313 of link 310 (described above in connection with FIG. 4A), is generally straight with outward curving portions, that are received in coils 316 of link 310. Handle 340 is thereby rotatably connected to link 310. When strip 300 is in the ground, handle 340 may lie flat on the ground.

Figure 5A:
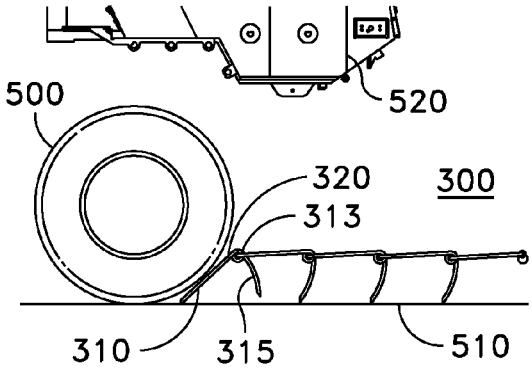
FIGS. 5A and 5B illustrate a method of driving spikes of the grounding strip of FIG. 3 into a grounding surface.
Figure 5B:
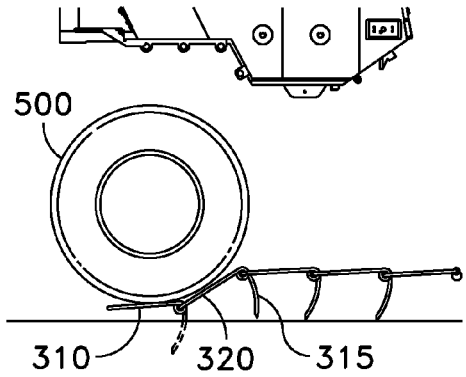

Illustrated in FIGS. 5A and 5B, is a method for grounding equipment using the rollover electrical spike strip 300. The strip 300 is laid on ground 510 in a desired pattern, with spikes 315 of the links 310, 320 pointing toward the ground 510. Spikes 315 are in contact with the ground 510, and are substantially supporting strip 300. A load is then moved onto spike strip 300. In one embodiment, the load may be a wheeled vehicle, having wheel 500. The wheeled vehicle may be a self-propelled, motorized vehicle. The motorized vehicle may alternatively be a tracked vehicle. As the wheel 500 rolls over the strip 300, it forces the spikes 315 into the ground 500. In FIG. 5A, link 310 is positioned so that segment 313 and points of spikes 315 are generally in contact with the ground. As spikes 315 are curved toward planar portion 317, the points of spikes 315 are substantially orthogonal to the ground. As wheel 500 moves forward, link 310 is rotated so that spikes 315 are driven into the ground. As the spikes of link 310 are driven into the ground, coils 316 of link 310 are moved to the ground. Segment 313 of link 320, which is disposed through coils 316 of link 316, is thus moved closer to the ground, causing link 320 to rotate such that the planar portion 317 of the link 320 is positioned tangentially to the wheel 500 and spikes 315 of link 320 are pointed closer to orthogonal to the ground, as shown in FIG. 5B. As portion 317 is planar, wheel 500 may easily continue rolling once spikes 315 of link 310 have been completely driven into the ground. The wheel 500 then rolls over the link 320, and forces the spikes 315 of the link 320 into the ground. Similarly, as the spikes of each link are forced into the ground, the planar portion 317 of the subsequent link becomes tangential to the wheel 500, and spikes 315 of the subsequent link are oriented closer to orthogonal to the ground. Since all the spikes 315 are electrically connected by the ground strap 330 (of FIG. 3), the equipment is grounded when the ground strap is connected to the equipment.

Figure 6:
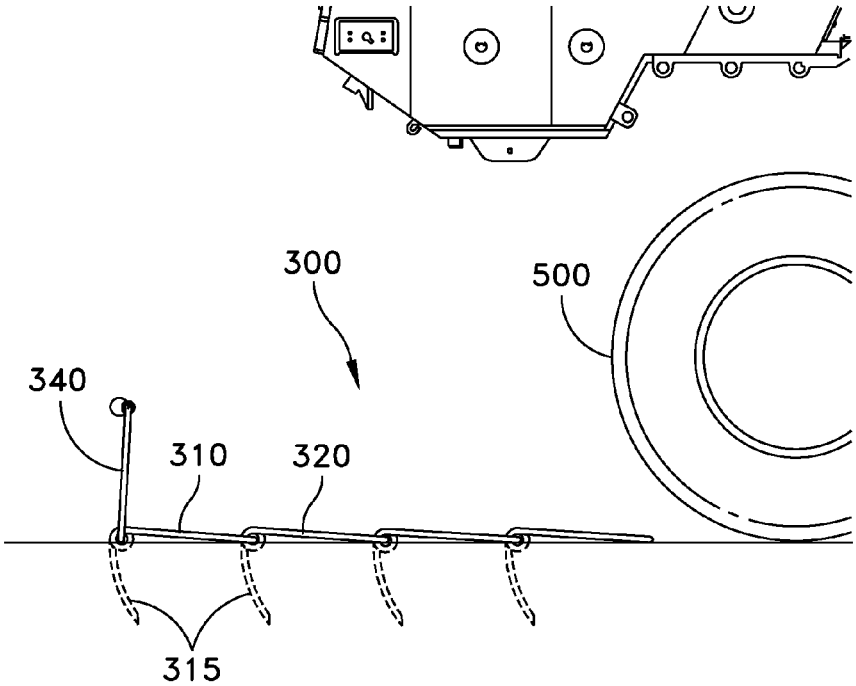
FIG. 6 illustrates lodging of spikes of the strip of FIG. 3 in a grounding surface and removal of the strip.

Now referring to FIG. 6, the entire strip 300 is shown after each of spikes has been driven into the ground. All of the spikes 315 are lodged firmly into the ground. The handle 340 can be used to pull the strip 300 out of the ground when the strip is no longer needed, such as when the equipment is being moved again. Gripping segment 344 of handle 340 may be engaged and pulled upward, so that initially handle 340 rotates about its connection to link 310. As a user continues to apply a manual or mechanical force to gripping segment 344, link 310, and then successively the remaining links, are pulled out of the grounding surface.

Figure 7:
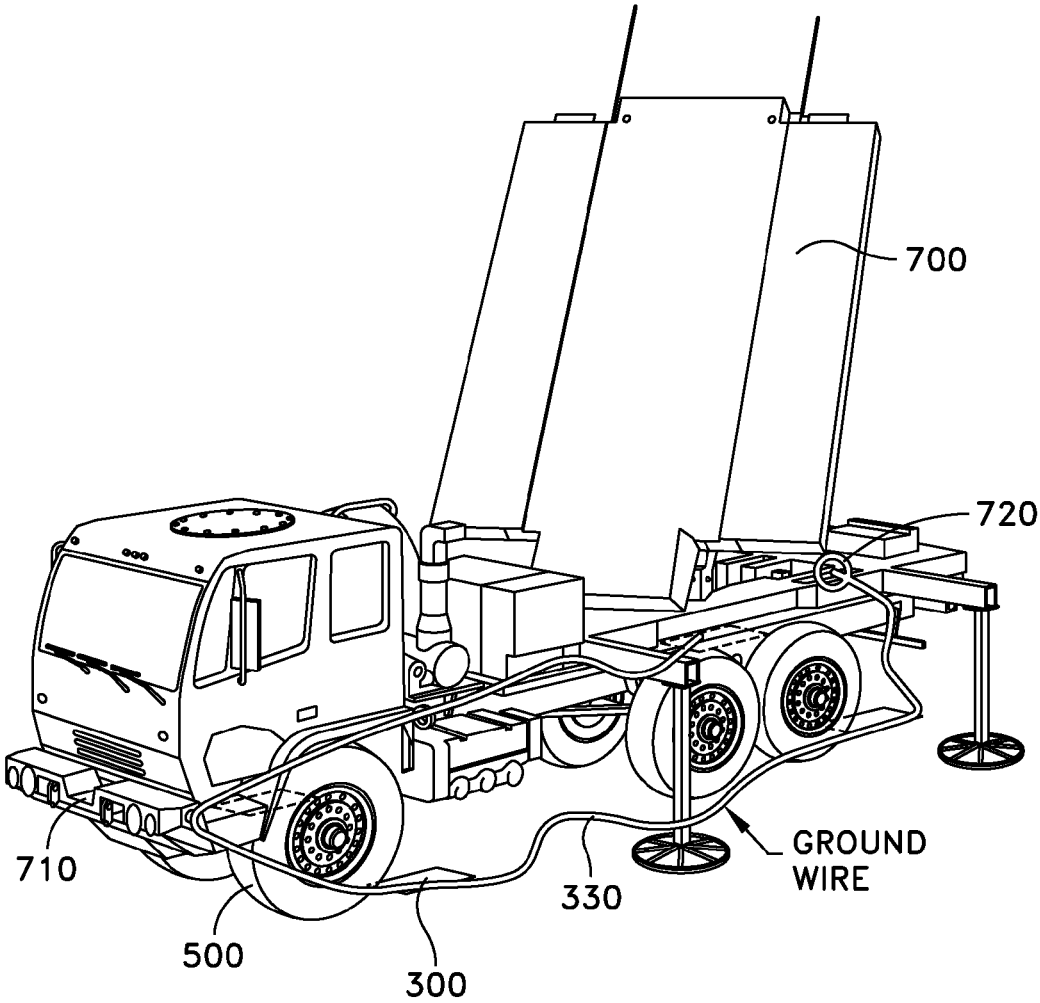
FIG. 7 illustrates an electrical system grounded employing electrical grounding spike strips in accordance with an embodiment of the invention.

FIG. 7 illustrates an electrical system 700 grounded employing electrical grounding spike strips in accordance with an embodiment of the invention. A wheeled vehicle 710, having wheels 500, carries an electrical device 700, which includes a radar array 710 in this example. Four electrical grounding spike strips 300 are deployed, with the spikes 315 of each firmly lodged into the grounding surface 510, providing good electrical contact between the spikes and the grounding surface. Grounding strap 330 is electrically connected to each spike strip 300 and to attachment 720 for grounding device 700. Thus, device 700 is grounded.

Figure 1:
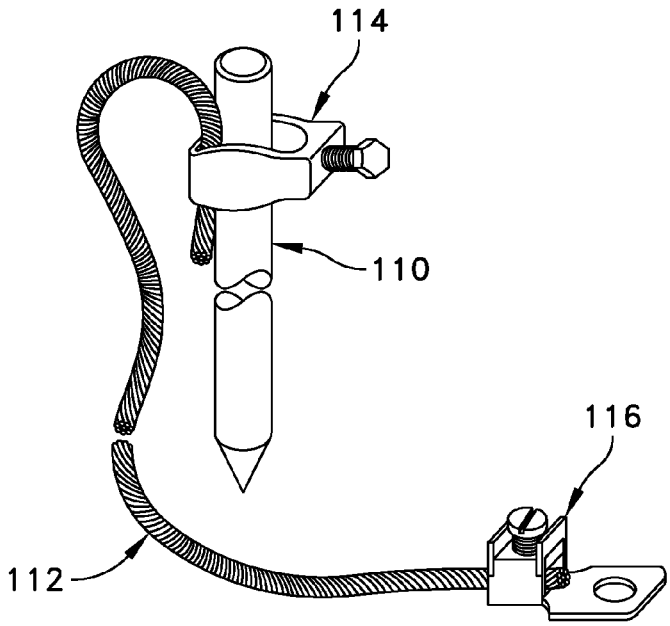
FIG. 1 (PRIOR ART)
FIG. 1 illustrates a prior art device for grounding electrical equipment.
Figure 2:
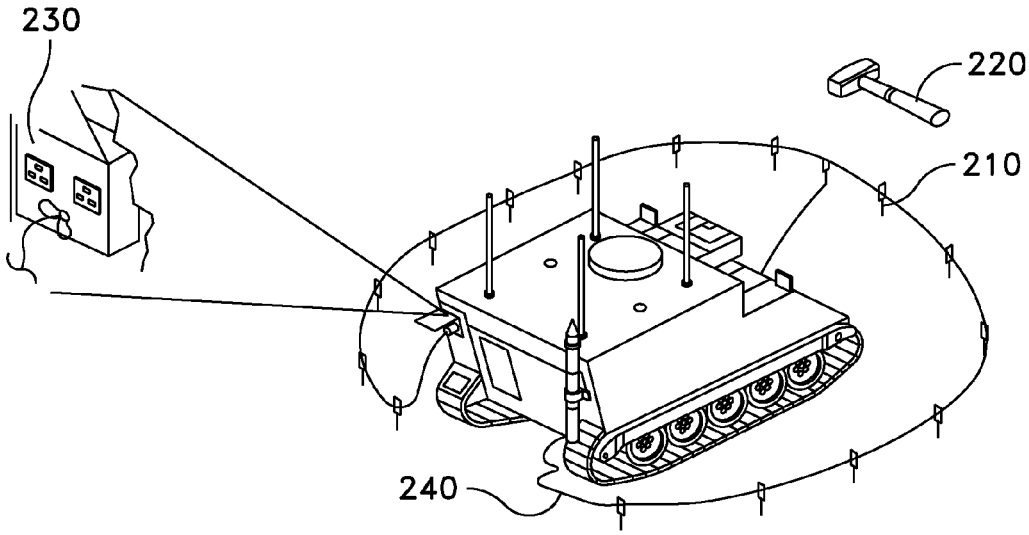
FIG. 2 (PRIOR ART)
FIG. 2 illustrates a prior art system for grounding a mobile electrical system.

An exemplary advantage of a ground strip in accordance with an embodiment of the invention is that, since the weight of a vehicle is used to embed the spikes in the ground, significant savings in crew effort and time are achieved in providing for grounding of mobile electrical devices when compared with the methods illustrated in FIGS. 1 and 2. A further exemplary advantage is that significant savings in crew effort and time are achieved in removing a spike strip in accordance with an embodiment of the invention from the ground. The use of a spike strip in accordance with an embodiment of the invention thus facilitates rapid deployment of mobile electrical systems. It is further advantageous that a grounding strip in accordance with an embodiment of the invention is reusable.

It will be apparent to those skilled in the art that modifications and variations may be made in the apparatus and process of the present invention without departing from the spirit or scope of the invention.

What is claimed is:

1. An electrical grounding strip comprising:

a first link comprising an elongated electrical conductor and a second link comprising an elongated electrical conductor, said second link rotatably connected directly to said first link via a loop in said elongated electrical conductor of said first link, said loop receiving said elongated electrical conductor of said second link, each of said first and second links having an elongated electrically conductive portion lying substantially in a plane and having at least one electrically conductive spike attached to said portion, said spike projecting generally orthogonally to said plane; and a flexible electrical conductor in electrically conductive contact with said spike of each of said first and second links.

2. The electrical grounding strip of claim 1, further comprising a handle, directly attached to said first link.

3. The electrical grounding strip of claim 2, wherein said handle comprises a generally rectangular frame.

4. The electrical grounding strip of claim 1, wherein each of said first and second links comprises a single piece of elongated electrically conductive material.

5. The electrical grounding strip of claim 1, wherein said electrically conductive portion lying substantially in a plane of said first link further comprises:

a first and a second segment having a first and a second end; and a third segment, said third segment connected to said second ends of each of said first and second segment.

6. The electrical grounding strip of claim 5, wherein said spike of said first link is connected to said first end of said first segment.

7. The electrical grounding strip of claim 6, wherein said loop is defined in said first link at a connection between said spike of said first link and said first end of said first segment.

8. The electrical grounding strip of claim 7, wherein said third segment of said second link is received in said loop defined in said first link, thereby rotatably connecting said first and second links.

9. The electrical grounding strip of claim 1, wherein each of said first and second links are identical.

10. The electrical grounding strip of claim 1, wherein each of said links further comprises a second spike, each of said spikes of said first link being curved toward said plane of said portion lying substantially in a plane of said first link, and each of said spikes of said second link being curved toward said portion lying substantially in a plane of said second link.

11. A method for grounding equipment, said method comprising the steps of:

placing a strip made of a first link comprising an elongated electrically conductive member and a second link comprising an elongated electrically conductive member, said second link rotatably connected directly to said first link via a loop in said elongated electrically conductive member of said first link, said loop receiving said elongated electrically conductive member of said second link, each of said first and second links having an elongated electrically conductive portion lying substantially in a plane and at least one spike, said spike of said first link projecting generally orthogonally to said plane of said portion lying substantially in a plane of said first link, said spike of said second link projecting generally orthogonally from said plane of said portion lying substantially in a plane of said second link, on a grounding surface, said strip positioned such that each of said spikes of said first and second links is in contact with the grounding surface;

electrically connecting each of said spikes to said equipment; and applying a load to each of said links to force each of said spikes into the grounding surface.

12. The method of claim 11, wherein said step of electrically connecting comprises connecting a flexible conductor to each of said first and second links.

13. The method of claim 11, wherein said strip further comprises a handle, said handle attached to said first link, and said method further comprises the step of pulling said handle upward to remove said strip from the grounding surface.

14. The method of claim 11, wherein each of said first and second links comprises a single piece of elongated electrically conductive material.

15. The method of claim 11, wherein said portion lying substantially in a plane of said first link further comprises:

a first and a second generally parallel segments each having a first and a second end; and a third segment, said third segment connected to said second ends of each of said first and second segment.

16. The method of claim 15, wherein said spike of said first link is connected to said first end of said first segment.

17. The method of claim 16, wherein said loop is defined in said first link at a connection between said spike of said first link and said first end of said first segment.

18. The method of claim 11, wherein said step of applying a load comprises rolling a wheel of a self-propelled wheeled vehicle on each of said links.

19. The method of claim 18, wherein said equipment is mounted on said vehicle.

20. The method of claim 11, wherein said spike of said first link is curved toward said plane of said portion of said first link lying substantially in a plane and said spike of said second link is curved toward said plane of said portion of said second link lying substantially in a plane.

* * * * *